US010453388B2

(12) United States Patent
Lee et al.

(10) Patent No.: US 10,453,388 B2
(45) Date of Patent: Oct. 22, 2019

(54) LIGHT-EMITTING DIODE DISPLAYS WITH PREDICTIVE LUMINANCE COMPENSATION

(71) Applicant: Apple Inc., Cupertino, CA (US)

(72) Inventors: Jiye Lee, Mountain View, CA (US); Yifan Zhang, San Carlos, CA (US); Chieh-Wei Chen, Campbell, CA (US); Tae-Wook Koh, Los Gatos, CA (US); Hongwei Chang, San Jose, CA (US); Paul S. Drzaic, Morgan Hill, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/967,402

(22) Filed: Apr. 30, 2018

(65) Prior Publication Data

US 2018/0247588 A1 Aug. 30, 2018

Related U.S. Application Data

(63) Continuation-in-part of application No. 15/237,500, filed on Aug. 15, 2016, now Pat. No. 9,997,104, (Continued)

(51) Int. Cl.
*G09G 3/3225* (2016.01)
*G09G 3/20* (2006.01)
(Continued)

(52) U.S. Cl.
CPC ..... *G09G 3/3225* (2013.01); *G09G 3/32* (2013.01); *G09G 3/2003* (2013.01); (Continued)

(58) Field of Classification Search
CPC combination set(s) only.
See application file for complete search history.

(56) References Cited

U.S. PATENT DOCUMENTS 6,094,639 A * 7/2000 Kubota ..... G06Q 30/02 705/1.1
9,368,683 B1 * 6/2016 Meitl ..... H01L 33/20
(Continued)

*Primary Examiner* — Patrick N Edouard
*Assistant Examiner* — Peijie Shen
(74) *Attorney, Agent, or Firm* — Treyz Law Group; Jason Tsai

(57) ABSTRACT

An electronic device may be provided with a display. A content generator may generate frames of image data to be displayed on the display. The display may have an array of pixels that emit light to display images. The pixels may contain light-emitting devices such as organic light-emitting diodes, quantum dot light-emitting diodes, and light-emitting diodes formed from discrete semiconductor dies. As a result of aging, the light producing capabilities of the light-emitting devices may degrade over time. The electronic device may have a temperature sensor that gathers temperature measurements and an ambient light sensor. A pixel luminance degradation compensator may apply compensation factors to uncorrected pixel luminance values associated with the frames of image data to produce corresponding corrected pixel luminance values for the display. The compensation factors may be based on aging history information such as pixel luminance history, ambient light exposure, and temperature measurements.

19 Claims, 9 Drawing Sheets

Related U.S. Application Data which is a continuation-in-part of application No. 14/936,343, filed on Nov. 9, 2015, now Pat. No. 10,163,388.

(60) Provisional application No. 62/218,445, filed on Sep. 14, 2015.

(51) Int. Cl.
*H05B 33/08* (2006.01)
*G09G 3/32* (2016.01)
*H05B 37/02* (2006.01)

(52) U.S. Cl.
CPC . *G09G 2320/041* (2013.01); *G09G 2320/046* (2013.01); *G09G 2320/048* (2013.01); *G09G 2320/0666* (2013.01); *G09G 2360/144* (2013.01); *H05B 33/0857* (2013.01); *H05B 37/0218* (2013.01)

(56) References Cited

U.S. PATENT DOCUMENTS 9,401,020 B1* 7/2016 Li ..... G06K 9/481
2005/0280766 A1* 12/2005 Johnson ..... G09G 3/3216 349/167
2006/0012708 A1* 1/2006 Rosmalen ..... G09G 3/3208 348/503
2006/0077136 A1* 4/2006 Cok ..... G09G 3/3216 345/76
2006/0187182 A1* 8/2006 Yu ..... G09G 5/10 345/102
2006/0227085 A1* 10/2006 Boldt, Jr. ..... G09G 3/32 345/83
2007/0079381 A1* 4/2007 Hartung ..... G06F 21/10 726/26
2007/0290957 A1* 12/2007 Cok ..... G09G 3/3225 345/77
2008/0055339 A1* 3/2008 Chao ..... G09G 3/2003 345/690
2008/0062112 A1* 3/2008 Umezaki ..... G09G 3/342 345/100
2008/0174515 A1* 7/2008 Matthies ..... G02F 1/13336 345/1.3
2008/0303918 A1* 12/2008 Keithley ..... G09G 3/20 348/223.1
2010/0123694 A1* 5/2010 Cok ..... G09G 3/20 345/206
2010/0201275 A1* 8/2010 Cok ..... G06F 3/0412 315/158
2011/0095291 A1* 4/2011 Quitoriano ..... C30B 25/02 257/52
2011/0181572 A1* 7/2011 Chen ..... G09G 3/3233 345/211
2012/0151258 A1* 6/2012 Lee ..... G06F 11/1417 714/15
2014/0015824 A1* 1/2014 Chaji ..... G09G 3/32 345/212
2014/0055500 A1* 2/2014 Lai ..... G09G 3/3208 345/690
2014/0176444 A1* 6/2014 Sultenfuss ..... G06F 1/1677 345/168
2014/0225938 A1* 8/2014 Soni ..... G09G 3/3233 345/690
2014/0292342 A1* 10/2014 Chaji ..... G09G 3/006 324/414
2014/0306868 A1* 10/2014 Chaji ..... G09G 3/006 345/77
2014/0368416 A1* 12/2014 Gu ..... G09G 3/3233 345/78
2015/0026485 A1* 1/2015 Mostovych ..... G06F 21/86 713/194
2015/0070402 A1* 3/2015 Shah ..... G09G 3/2003 345/690
2015/0103106 A1* 4/2015 Chaji ..... G09G 3/3291 345/690
2015/0108516 A1* 4/2015 Yang ..... H01L 33/44 257/89
2016/0042676 A1* 2/2016 Berkeley ..... G09G 3/006 345/589
2016/0099262 A1* 4/2016 Lin ..... H01L 27/3255 257/43
2016/0126293 A1* 5/2016 Li ..... H01L 33/06 257/29
2016/0150623 A1* 5/2016 Uemura ..... H05B 33/0896 399/220
2016/0358539 A1* 12/2016 Zhang ..... H01L 27/32
2017/0278733 A1* 9/2017 Chang ..... H01L 21/67144
2018/0018940 A1* 1/2018 Biebersdorf ..... G09G 3/32
2018/0151119 A1* 5/2018 Lee ..... G09G 3/3291
2018/0330697 A1* 11/2018 Lee ..... G09G 5/373

* cited by examiner

LIGHT-EMITTING DIODE DISPLAYS WITH PREDICTIVE LUMINANCE COMPENSATION

This application is a continuation-in-part of U.S. patent application Ser. No. 15/237,500, filed Aug. 15, 2016, which is a continuation-in-part of U.S. patent application Ser. No. 14/936,343, filed Nov. 9, 2015, which claims the benefit of provisional patent application No. 62/218,445 filed on Sep. 14, 2015, all of which are hereby incorporated by reference herein in their entireties.

BACKGROUND

This relates generally to electronic devices with displays, and, more particularly, to displays with pixels that are subject to aging effects.

Electronic devices often include displays. Displays such as light-emitting diode displays have individually controlled pixels. These pixels emit light to display images for a user. Light-emitting structures in the pixels of a display may be subject to aging effects. As a result, pixel luminance can drop over time. The luminance of pixels that are lightly used may be relatively stable as a function of time, whereas the luminance of pixels that are heavily used may degrade as a function of time. In color displays, pixels of different colors may age differently, leading to potential color shifts over time. Light exposure may also affect pixel aging. These effects may affect display performance.

It would therefore be desirable to be able to provide ways to overcome undesired pixel aging effects in devices with displays.

SUMMARY

An electronic device may be provided with a display. A content generator may generate frames of image data to be displayed on the display.

The display may have an array of pixels. The pixels may emit light to display images for a user. The pixels may contain light-emitting devices such as organic light-emitting diodes, quantum dot light-emitting diodes, and light-emitting diodes formed from discrete semiconductor dies.

As a result of aging, the light producing capabilities of the light-emitting devices in the display may degrade over time. To ensure that images that are appropriately displayed on the display, aging history information may be stored in the device for each of the pixels in the display. The aging history information may take into account the luminance history of each pixel, ambient light exposure information, and, if desired, operating temperature information.

A pixel luminance degradation compensator may compute compensation factors based on the aging history. The pixel luminance degradation compensator may apply the compensation factors to uncorrected pixel luminance values associated with the frames of image data to produce corresponding corrected pixel luminance values for the display.

Displays may be characterized and associated with batches of displays that have respective display batch characteristics. The pixel luminance degradation compensator can apply compensation factors for a given display based at least partly on display batch characteristics associated with a batch of displays that includes the given display.

The ambient light exposure information that is taken into account when compensating the pixels for aging may include ambient light sensor measurements from a color ambient light sensor that are indicative of ultraviolet light exposure.

Further features will be more apparent from the accompanying drawings and the following detailed description.

DETAILED DESCRIPTION

Figure 1:
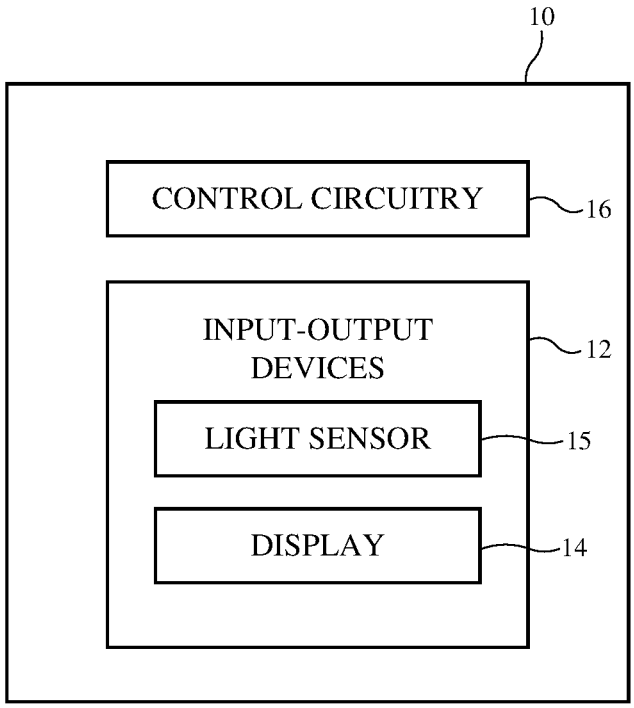
FIG. 1 is a schematic diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

The sensors in devices 12 may include, for example, an ambient light sensor such as sensor 15. Ambient light sensor 15 may gather information on the light exposure of device 10 and therefore the light exposure of display 14. This light exposure information may be gathered periodically (e.g., once per second, once per minute, once per hour, or at other suitable time intervals). Light exposure information can be gathered at one or more wavelengths (e.g., at one or more visible light wavelengths, at ultraviolet light wavelengths, etc.). Ambient light sensor 15 may be a color ambient light sensor that gathers an ambient light spectrum over a range of different wavelengths and/or may include multiple individual ambient light sensors that gather information at desired wavelengths (e.g., a color or monochromatic visible-light ambient light sensor, an ultraviolet-light ambient light sensor, etc.).

Light exposure may age display 14 both while display 14 is operating and while display 14 is turned off. Accordingly, ambient light sensor 15 may be used to gather light exposure information for device 10 and display 14 whether or not display 14 is turned on. Ambient light sensor 15 is preferably oriented in a direction that gathers ambient light readings for ambient light that is incident on display 14. For example, if display 14 is mounted on a front face of device 10, ambient light sensor 15 may also be mounted on the front face of device 10. If desired, ambient light sensor 15 is one of a series of multiple ambient light sensors placed at diverse locations on the housing of device 10, so that if one sensor is occluded, the other sensors can still make ambient light history measurements. Ambient light sensors such as sensor 15 may be positioned in a portion of device 10 (e.g., adjacent to the border of display 14) that causes these sensors to be blocked from light exposure when display 14 is covered (e.g., when display 14 is covered with an accessor cover, etc.).

Control circuitry 16 may be used to run software on device 10 such as operating system code and applications. During operation of device 10, the software running on control circuitry 16 may display images on display 14 using an array of pixels in display 14.

Device 10 may be a tablet computer, laptop computer, a desktop computer, a display, a cellular telephone, a media player, a wristwatch device or other wearable electronic equipment, or other suitable electronic device.

Display 14 may contain pixels based on light-emitting devices. The light-emitting devices may be light-emitting diodes (e.g., organic light-emitting didoes, micro-light-emitting diodes formed from discrete crystalline semiconductor dies, quantum dot light-emitting diodes, etc.) or other light-emitting components. Display 14 may be a monochrome display or a color display. In a color display, the pixels may include red, green, and blue pixels or other sets of pixels of different colors (e.g., cyan pixels, white pixels, yellow pixels, etc.).

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
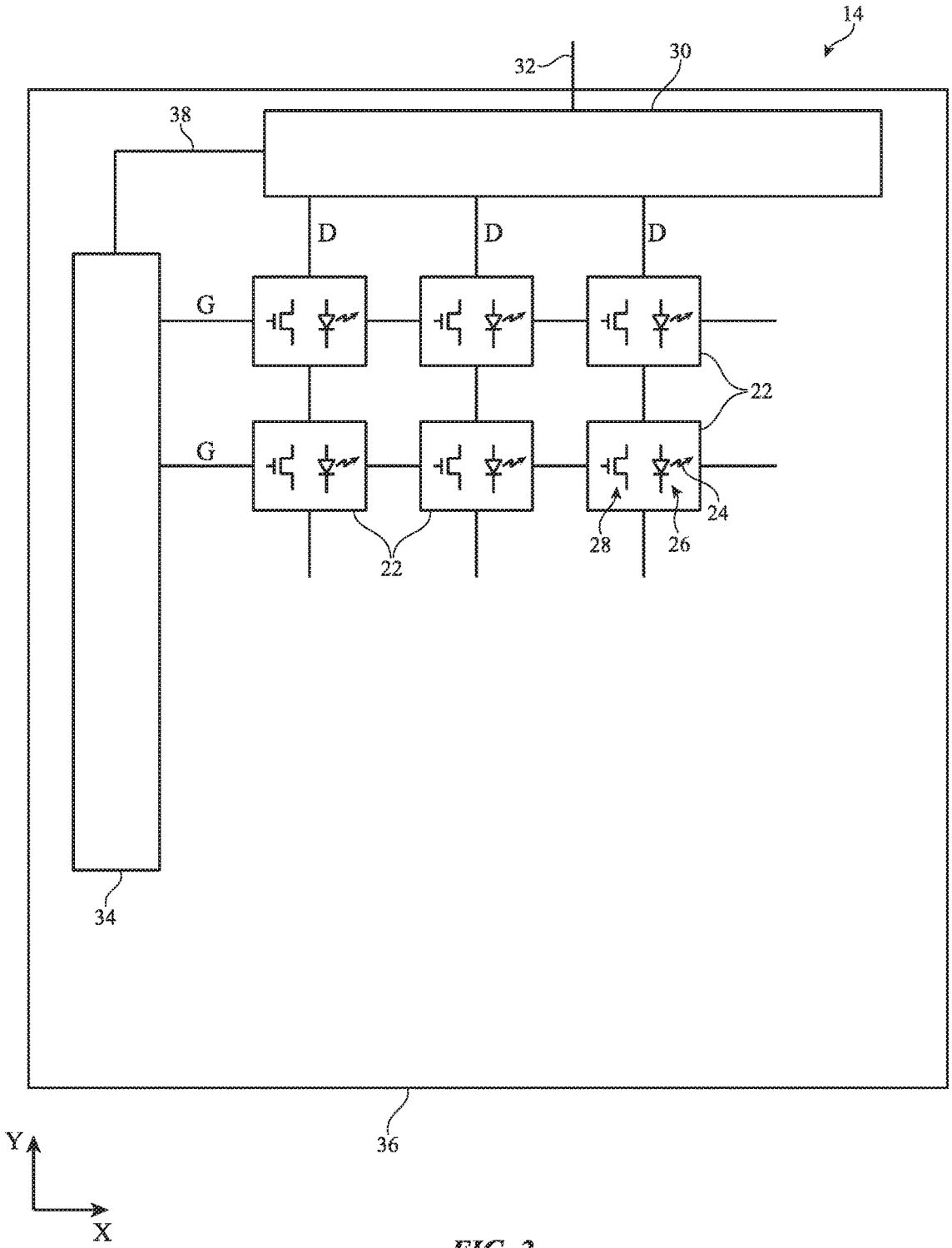
FIG. 2 is a top view of an illustrative display in an electronic device in accordance with an embodiment.

A top view of a portion of display 14 is shown in FIG. 2. As shown in FIG. 2, display 14 may have an array of pixels 22 formed on substrate 36. Substrate 36 may be formed from glass, metal, plastic, ceramic, or other substrate materials. Pixels 22 may receive data signals over signal paths such as data lines D and may receive one or more control signals over control signal paths such as horizontal control lines G (sometimes referred to as gate lines, scan lines, emission control lines, etc.). There may be any suitable number of rows and columns of pixels 22 in display 14 (e.g., tens or more, hundreds or more, or thousands or more). Pixels 22 may extend horizontally in rows along lateral dimension x and vertically in columns along lateral dimension y.

Each pixel 22 may have a light-emitting component such as one of light-emitting diodes 26 that emits light 24 under the control of a pixel control circuit. Pixel control circuits may be formed from components such as transistors. With one illustrative configuration, pixel control circuitry may be formed from thin-film transistor circuitry such as thin-film transistors 28 and thin-film capacitors. Transistors 28 may be silicon transistors, polysilicon thin-film transistors, semiconducting-oxide thin-film transistors such as indium zinc gallium oxide transistors, or thin-film transistors formed from other semiconductors. Pixels 22 may contain light-emitting diodes 26 of different colors (e.g., red, green, and blue or other colors) to provide display 14 with the ability to display color images.

Display driver circuitry may be used to control the operation of pixels 22. The display driver circuitry may be formed from integrated circuits, thin-film transistor circuits, or other suitable circuitry. Display driver circuitry 30 of FIG. 2 may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply circuitry 30 with information on images to be displayed on display 14.

To display the images on display pixels 22, display driver circuitry 30 may supply image data to data lines D while issuing clock signals and other control signals to supporting display driver circuitry such as gate driver circuitry 34 over path 38. If desired, circuitry 30 may also supply clock signals and other control signals to gate driver circuitry on an opposing edge of display 14.

Gate driver circuitry 34 (sometimes referred to as horizontal control line control circuitry) may be implemented as part of an integrated circuit and/or may be implemented using thin-film transistor circuitry. Horizontal control lines G in display 14 may carry gate line signals (scan line signals), emission enable control signals, and other horizontal control signals for controlling the pixels of each row. There may be any suitable number of horizontal control signals per row of pixels 22 (e.g., one or more, two or more, three or more, four or more, etc.).

In organic light-emitting diode displays, colored emissive material may be used to provide the light-emitting diodes with the ability to emit red, green, and blue light (or light of other colors). For example, red organic light-emitting diodes may contain red organic emissive material, green organic light-emitting diodes may contain green organic emissive material, and blue organic light-emitting diodes may contain blue organic emissive material. The emissive material may degrade as the light-emitting diodes are used. Heavy use, in which diodes are driven with large currents, may age the diodes more rapidly than light use, in which the diodes are driven with small currents. As the diodes age, the degraded emissive material will cause the diodes to emit a reduced amount of light for a given drive current. Pixel luminance in organic light-emitting diode displays is therefore generally a function of the aging history of the pixels in the display. Because emissive material of different colors tends to age differently, color shifts may arise as a organic light-emitting diode display ages. Color shifts may also arise due to aging effects in displays such as micro-light-emitting diode displays (i.e., displays with arrays of discrete light-emitting diode dies) and quantum dot displays.

To compensate for these undesired aging-induced color shifts and therefore ensure that display 14 can display images accurately, device 10 may be provided with pixel luminance degradation compensation capabilities. In particular, the control circuitry of device 10 may be used to implement a pixel luminance degradation compensator that maintains information on the aging history of each of the pixels in display 14. Based on this aging information, the pixel luminance degradation compensator can adjust the luminance values supplied to each of the pixels in display 14. During operation, the pixels that have degraded due to aging may be supplied with pixel luminance values that have been increased to offset the expected reduced light output of these pixels. This ensures that the color of images displayed on display 14 will remain stable and accurate as a function of time, even if the luminance of some of the pixels in the display has decreased due to aging effects.

Figure 3:
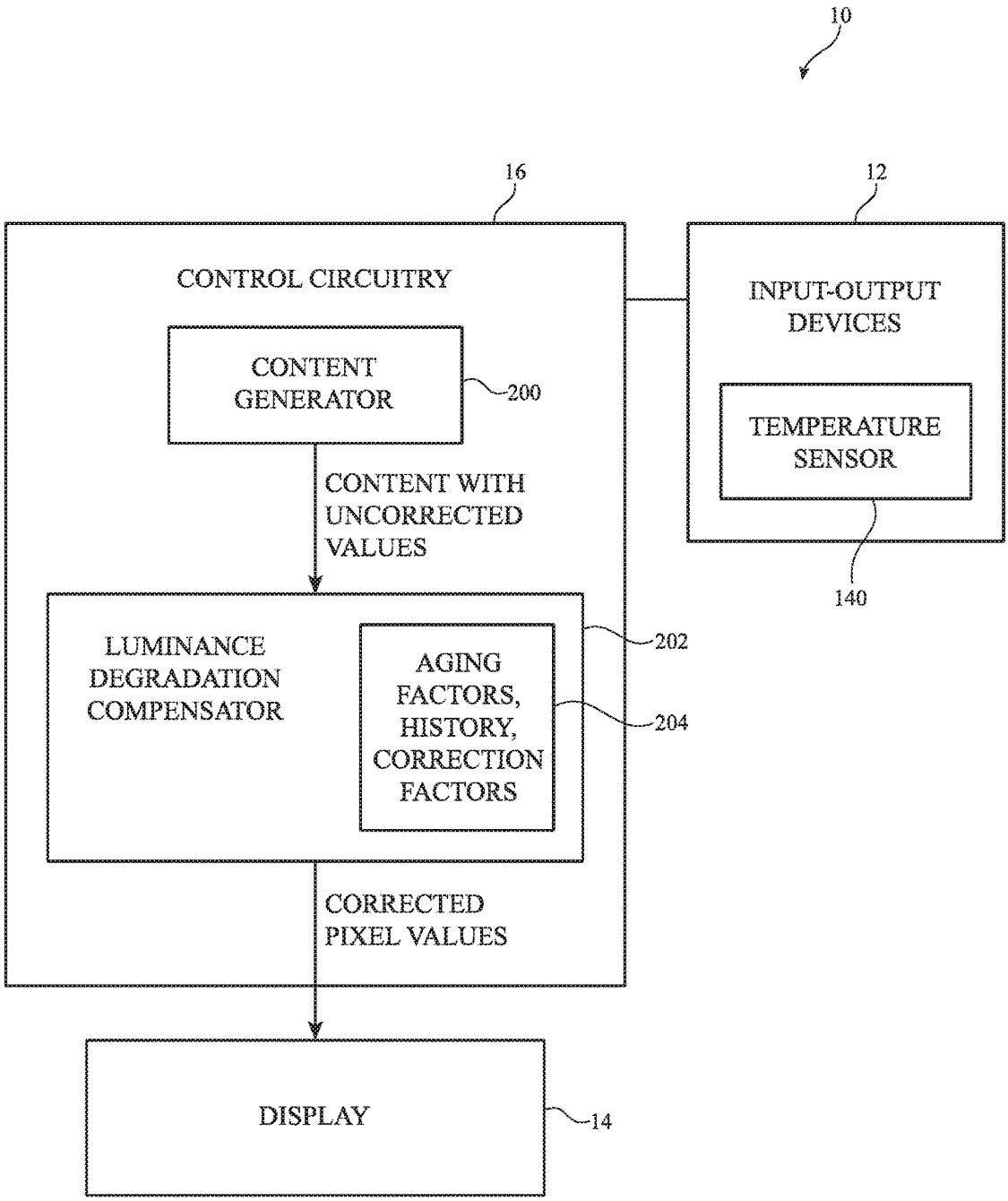
FIG. 3 is a schematic diagram of an illustrative electronic device with a display in accordance with an embodiment.

Illustrative circuitry of the type that may be used by device 10 to control display 14 while monitoring aging effects is shown in FIG. 3. As shown in FIG. 3, device 10 may have control circuitry 16. Content generator 200 may be an application running on control circuitry 16 such as a game, a media playback application, an application that presents text to a user, an operating system function, or other code running on control circuitry 16 that generates image data to be displayed on display 14. The image data may include pixel values (sometime referred to as pixel luminance values) for each of the pixels in display 14. Image data may be generated in image frames.

Pixel luminance degradation compensator 202 may be implemented on control circuitry 16. Control circuitry 16 may include storage for maintaining information 204 that is used by compensator 202. For example, control circuitry 16 may have storage for maintaining information 204 that compensator 202 uses to adjust the luminance values for content from content generator 200 before that content is supplied to display 14. Information 204 may include information on how pixel luminance varies as a function of use (sometime referred to as aging factor information), information on the usage history of each pixel or set of pixels (e.g., historical aging information based on the luminance values supplied to the pixels over the lifetime of display 14 and, if desired, operating temperature information), information on corresponding correction factors that can be applied to the pixels to compensate for aging-induced luminance degradation, and other information for supporting the operation of pixel luminance degradation compensator 200). To ensure that compensator 202 can accurately compensate display 114 for aging effects even in the event that other device settings are reset, it may be desirable to maintain information 204 in protected storage (e.g., a protected memory space that will not be overwritten when reinstalling the operating system for device 10, when updating the operating system or other settings for device 10, when resetting device 10 to default factory settings, or when otherwise installing operating system code, updates, etc.). Information 204 may also be encrypted to prevent analysis by third parties who may try to access the information 204 to determine content displayed on display 114 during its usage. Control circuitry 16 may maintain information 204 in its encrypted state when transmitted within device 10 and/or when stored within device 10. For example, information 204 that is generated by compensator 202 may be encrypted when stored by compensator 202 and may be decrypted when retrieved by compensator 20. In this way, information 204 is kept secure from unauthorized access and monitoring.

Control circuitry 16 may be coupled to input-output circuitry such as input-output devices 12. Input-output devices 12 may include a temperature sensor such as temperature sensor 140 to gather information on the current operating temperature of display 14. If desired, this temperature information can be used in maintaining the aging history for the pixels in display 14. At high operating temperatures, aging effects are accelerated, so by monitoring the operating temperature of the pixels in display 14, color shifts associated with operation of display 14 at elevated temperatures can be compensated.

During manufacturing, display 14 (or a representative display of the same design) may be tested to determine the aging characteristics of the pixels in display 14. For example, accelerated aging tests may be performed to determine how much the pixels of each color age as a function of time, luminance, and optionally operating temperature. Exposure to visible light, ultraviolet light, or solar radiation may also be used as part of these accelerate tests. A look-up table or set of equations may be stored in device 10 that represents the measured aging characteristics of the pixels in display 14. Examples of functions that may be used to represent the luminance aging behavior of the pixels in display 14 include polynomial functions, exponential functions, logarithmic functions, trigonometric functions, series, etc.

Once the aging behavior of the pixels of display 14 has been stored in device 10, device 10 can be used to display images for a user. As each pixel is illuminated and used in displaying content for a user, the luminance of that pixel and the duration for which the pixel is driven at that luminance level may be used, in conjunction with the known aging behavior of the pixels, to determine that amount of aging experienced by that pixel (i.e., an aging history value). The aging history information for the pixels may be maintained in storage (e.g., as part of a matrix containing pixel aging history entries for all pixels in display 14 or other data structure). Temperature information may be taken into account when determining the aging history values for the pixels, if desired.

The matrix of aging history entries that is maintained may have the same number of entries as there are pixels in display 14 (i.e., a separate aging history may be maintained for each pixel in display 14) or averaged aging history information may be maintained for clusters of adjacent pixels (e.g., 2×2 blocks of pixels, 1×3 blocks of pixels, or other sets of pixels) to reduce storage requirements. Aging history entries may be maintained using any suitable level of accuracy (e.g., the digital words that are used to maintain the aging history information may have the same number of bits as the pixel luminance values used in displaying information on display 14, may have a larger number of bits, or may have a smaller number of bits (e.g., to reduce storage requirements).

The aging behavior of pixels of different colors will generally be different. Pixel aging effects will also generally be non-linear as a function of pixel luminance (and temperature, if monitored). As part of the process of determining the aging history for each pixel, it may therefore be desirable to compute aging factors based on luminance level and temperature level that can be used to help translate pixel luminance values (and operating temperatures) into expected amounts of pixel luminance degradation (aging).

Figure 4:
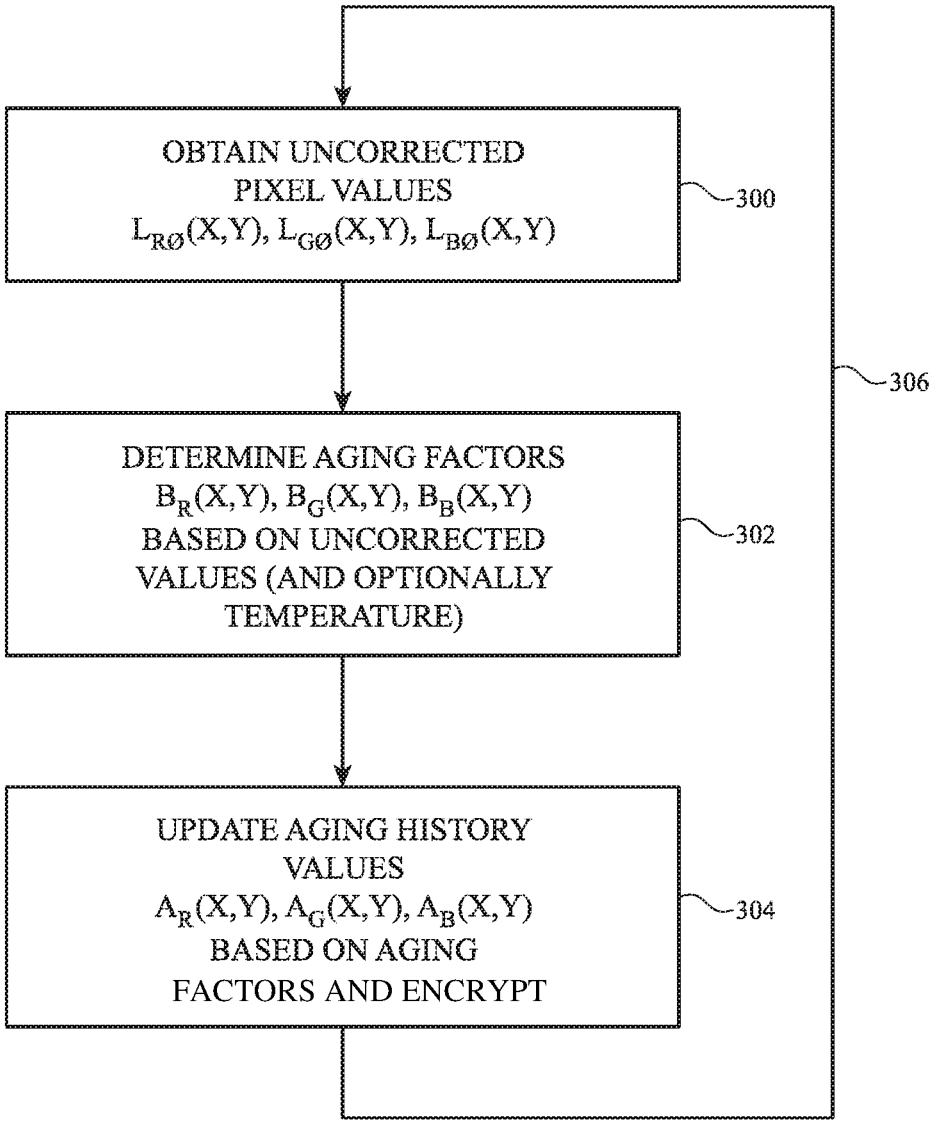
FIG. 4 is a flow chart of illustrative steps involved in maintaining pixel aging history information in an electronic device with a display in accordance with an embodiment.

FIG. 4 is a flow chart of illustrative steps involved in maintaining aging history information for display 14. At step 300, luminance degradation compensator 202 may obtain uncorrected pixel luminance values for the content generated by content generator 200. For example, compensator 202 may obtain the pixel luminance value for each pixel in a frame of image data to be displayed on display 14. The luminance values may include an uncorrected red pixel luminance value $L_{R0}(x,y)$ for each red pixel, an uncorrected green pixel luminance value $L_{G0}(x,y)$ for each green pixel, and an uncorrected blue pixel luminance value $L_{B0}(x,y)$ for each blue pixel. There may be any suitable number of luminance values associated with each pixel (e.g., 0-255, etc.).

Pixels at one luminance level (e.g., 0-10 nits) may age differently than pixels at another luminance level (e.g., 390-400 nits). Moreover, the amount of aging that each pixel experiences will generally be nonlinear as a function of luminance level (and temperature). For example, a pixel may degrade more if illuminated at 400 nits for one hour than if driven at 100 nits for four hours. To take account of these nonlinear aging effects, the aging behavior of the pixels may be ascertained during display testing and characterization and stored in the memory of control circuitry 16 (see, e.g., stored information 204). The aging behavior of the pixels may then be used in computing a value (sometimes referred to as an aging factor) for each pixel that represents how much a given pixel is being aged during a given display operation (e.g., when outputting light at a given luminance in an image frame). As shown in FIG. 4, aging factors B may be computed at step 302 based on the pixel luminance values in an image frame and, if desired, operating temperature. A separate aging factor B may be computed for each pixel in display 14 or aging factors may be computed and stored for blocks of pixels (e.g., 2×2 blocks or blocks of other sizes and shapes) to conserve memory. In scenarios in which compensator 202 computes an aging factor for each pixel in the frame of image data obtained at step 300, a frame-sized matrix of aging factors may be computed at step 302.

Aging factors B may be computed for each different color of pixel in display 14. For example, at 10 nits of illumination, red, green, and blue pixels in display 14 may each have a different corresponding value of aging factor B to take into account the varying behavior of each different pixel color during operation. At 20 nits of illumination, these factors may also be different and may change in a non-linear fashion. For example, the aging factor for blue pixels at 20 nits may be more than twice the aging factor for blue pixels at 10 nits and blue pixels may age more rapidly as a function of increasing luminance levels than red pixels (as an example). If desired, temperature information (e.g., a current measured temperature value from sensor 140) may be used in computing aging factors B.

The matrix of aging factors for red, green, and blue pixels that is produced at step 302 (i.e., red pixel aging factors $B_R(x,y)$, green pixel aging factors $B_G(x,y)$, and blue pixel aging factor $B_B(x,y)$) may be maintained as part of information 204 by compensator 202. To ensure that a complete (lifetime) history of aging effects for display 14 is maintained, the aging factors for the current frame that have been computed at step 302 may be used in updating a cumulative history matrix of aging history values A (i.e., a running history) at step 304. Aging history information for display 14 such as aging history values A(x,y) may include red pixel aging history values $A_R(x,y)$, green pixel aging history values $A_G(x,y)$, and blue pixel aging history values $A_B(x,y)$. As with the aging factors B, aging history information may be stored in a matrix that is equal in size to the image frame (e.g., a matrix with an aging history for each pixel in display 14) or may be stored in a reduced-size matrix (e.g., a matrix in which 2×2 blocks of adjacent pixels share a common aging history value) to conserve memory. This aging history information may optionally be encrypted during the operations of step 304 for secure storage in memory in control circuitry 16 to prevent unauthorized inspection. When retrieving and using encrypted information such as encrypted aging history information 204, compensator 202 may perform decryption operations. Encryption and decryption keys may be stored in tamper-proof memory in control circuitry 16.

After the current aging factors B have been used to update the aging history A for the pixels in display 14, processing may loop back to step 300, as indicated by line 306. A new set of uncorrected pixel values may be obtained and processed in this way at a frequency of f1. Frequency f1 may be, for example, 60 Hz (e.g., frequency f1 may correspond to the frame rate at which display 14 displays frames of image data). Other frequencies f1 may be used when performing the operations of FIG. 4, if desired (e.g., f1 may be 0.005 Hz to 60 Hz, etc.).

Figure 5:
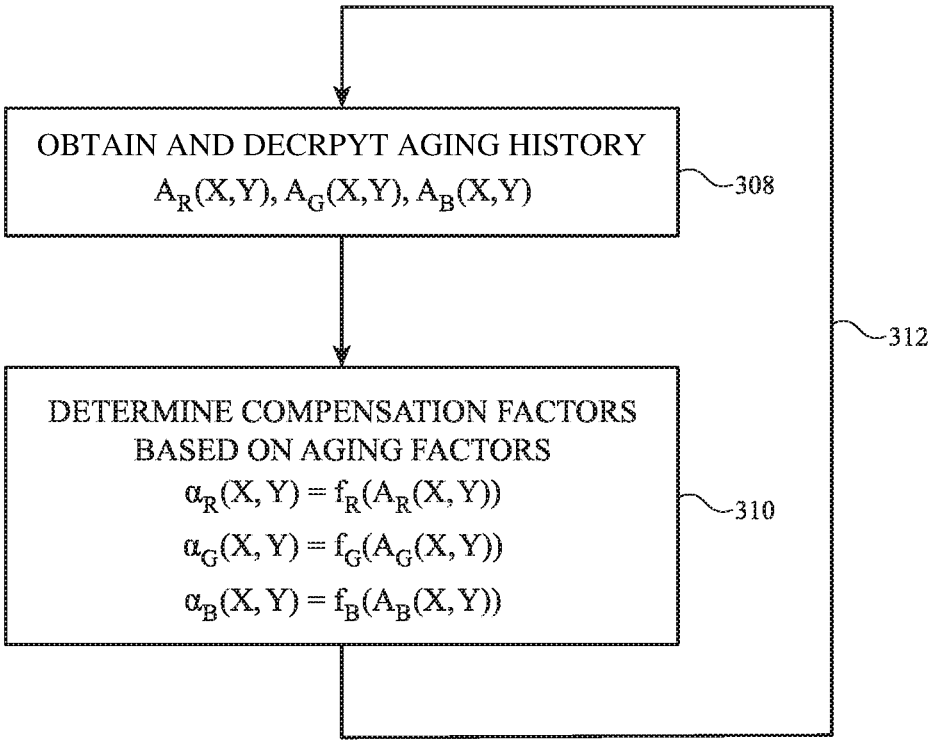
FIG. 5 is a flow chart of illustrative steps involved in updating a set of pixel aging compensation factors in an electronic device with a display in accordance with an embodiment.

The process of FIG. 4 may run continuously while image data is being displayed on display 14. In parallel, compensator 202 may maintain a set of pixel luminance compensation factors to apply to the uncorrected pixel values. FIG. 5 is a flow chart of illustrative operations involved in using current aging history information to update a set of pixel compensation values. At step 308, compensator 202 may obtain a current set of aging history values (entries A from the aging history matrix that is updated during the operations of step 304 in FIG. 4). These aging history values represent how much each pixel in display 14 has aged and has therefore degraded. If the aging history matrix has been stored in encrypted form, compensator 202 may decrypt the aging history information at step 308.

At step 310, pixel luminance degradation compensation factors $\alpha_R$, $\alpha_G$, and $\alpha_B$ may be determined for each of the red, green, and blue pixels of display 14, respectively. For example, at each value of x and y, a compensation factor for the red pixel at that location may be computed using age-induced-luminance-degradation estimation function $f_R$ (i.e., $\alpha_R=f_R(A_R(x,y))$. Compensation factors $\alpha_G$ (for the green pixels) and $\alpha_B$ (for the blue pixels) may be computed using corresponding age-induced-luminance-degradation estimation functions $f_G$ and $f_B$. Functions $f_R$, $f_G$, and $f_B$ may be obtained during manufacturing and testing operations when characterizing display 14 and may be maintained as part of information 204. Compensation factor information (i.e., the computed values of $\alpha$) may be stored in a matrix that is equal in size to a display image frame (e.g., a matrix with an compensation factor value for each pixel in display 14) or may be stored in a reduced-size matrix (e.g., a matrix in which 2×2 blocks of pixels or blocks of other numbers of pixels share a common compensation history value) to conserve memory.

As indicated by line 312, the process of FIG. 5 may be performed continually. The loop of FIG. 5 may be performed at a frequency f2. This frequency may, as an example, be lower than the frequency f1 of the loop of FIG. 4 (as an example). With one illustrative configuration, frequency f2 may be about 0.002 Hz to $10^{-6}$ Hz (as an example).

Figure 6:
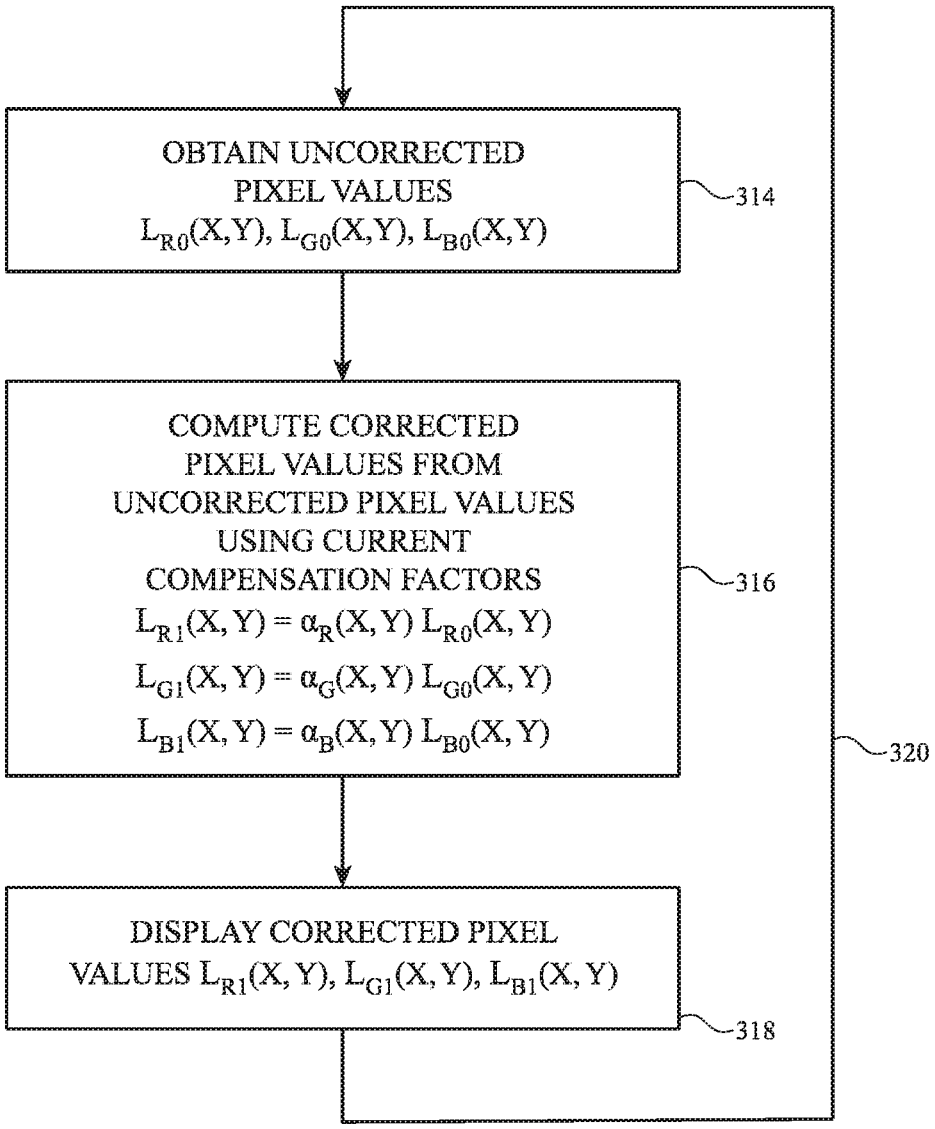
FIG. 6 is a flow chart of illustrative steps involved in displaying content on a display using corrected pixel values in accordance with an embodiment.

The aging history maintenance operations of FIG. 4 and the compensation factor updating operations of FIG. 5 may be performed at the same time that compensated content from content generator 200 is being displayed on display 14 by compensator 202 on control circuitry 16. Illustrative operations involved in compensating the uncorrected pixel values from content generator 200 with the compensation factors determined during the operations of FIG. 5 are shown in FIG. 6.

At step 314, compensator 202 may obtain uncorrected pixel values for a frame of image data from content generator 200.

At step 316, compensator 202 may compute corrected pixel luminance values for each pixel in the frame of image data. The corrected pixel values $L_{R1}$, $L_{G1}$, and $L_{B1}$ for red, green, and blue pixels, respectively, may be computed by applying the compensation factors $\alpha_R$, $\alpha_G$, and $\alpha_B$ that were computed during step 310 of FIG. 5. In particular, $L_{R1}=\alpha_R(x,y)\ L_{R0}(x,y)$, $L_{G1}=\alpha_G(x,y)\ L_{G0}(x,y)$, and $L_{B1}=\alpha_B(x,y)\ L_{B0}(x,y)$ for each of the pixel in display 14. Compensation factors $\alpha$ are used to increase the luminance values of pixels that have degraded emissive material or other age-induced damage that causes those pixels to emit less light for a given luminance value setting (i.e., drive current) than they were originally capable of emitting. The values of $\alpha$ will therefore be 1.0 for pixels that are operating with their original efficiency and will be more than 1.0 for pixels that have degraded. If desired, the compensation factors that are computed during the operations of step 310 (FIG. 5) may be encrypted for storage to enhance security and may then be decrypted during the operations of step 316.

At step 318, control circuitry 16 (e.g., compensator 202) may use display 14 to display an image frame containing the compensated (corrected) pixel luminance values of step 316.

As indicated by line 320, the process of FIG. 6 may be performed continuously (e.g., at frequency f3 equal to the frame rate with which compensator 202 supplies corrected images frames to display 14).

Display burn-in for display 14 may result when visible display artifacts arise from differential aging of pixels 22. For example, heavily used pixels may suffer more luminance decay than lightly used pixels. Predictive compensation techniques of the type described in connection with FIGS. 4 and 5 may help to compensate for display burn-in based on pixel usage history.

If desired, burn-in compensation techniques may also take into consideration other variables such as manufacturing variations. As an example, if manufacturing conditions render the pixels of displays in a first batch of displays weaker than pixels in a second batch of displays, the weaker pixels of the displays in the first batch of displays may be provided with more luminance compensation than the stronger pixels of the displays in the second batch of displays. By characterizing batches of displays and identifying associated display batch characterization information, burn-in compensation techniques may be enhanced in accuracy.

Consider, as an example, a manufacturing process that deposits thin-film layers when forming pixels 22. Due to manufacturing variations, some displays may have a thin-film layer that is thicker than others. The larger thickness of this layer may be correlated with stronger (or weaker) display pixel aging performance. As a result, knowledge of the thickness of the thin-film layer may be used to predict the aging behavior of the pixels. The use of layer thickness as a parameter for gauging aging performance is merely illustrative. As another example, process parameters used in manufacturing, or other information associated with the manufacturing equipment, can be used in the lifetime assessment. In general, any suitable display parameters or manufacturing information may be monitored and used to help predict aging behavior. Display parameters may be measured on a display-by-display basis (e.g., to allow individual display compensation) or may be measured in batches (e.g., to allow displays to be binned in accordance with one or more parameters or ranges of parameters that these displays have in common).

With a first illustrative arrangement, panels may be binned based on direct measurements. The burn-in rate of displays may, for example, be binned by stressing displays using predetermined image(s) and measuring luminance decay (e.g., for red, green, and blue pixels) as a function of stress time. Displays whose luminance decay is similar for comparable applied stress may be binned together. As another example, the burn-in rate of displays can be binned by stressing the displays using predetermined image(s) and measuring the luminance decay rate of white light output from the display and the chromaticity change rate of this white output as a function of time. With this approach, the measured color of the output light may reveal information on the aging of the red, green, and blue pixels using a single color measurement. Measurements can be performed on pixels in the active area of a display or on dummy pixels in an inactive display area. Light from the dummy pixels may be obscured from view by a user and/or dummy pixels may remain inactive during image display operations so that light from the dummy pixels does not to contribute to images displayed for the user. An ambient light sensor or other built-in light sensor adjacent to the pixels of display 14 may be use in measuring pixel output (e.g., after display fabrication is complete). Measurements may also be made in a factory.

Stressing and measurement acquisition operation may be performed under normal display operating temperatures and luminance values or may be performed under different operating conditions (e.g., accelerated display operating temperature and/or luminance conditions).

Measurements on displays 14 may be performed for a duration of more than 1 minute, more than 60 minutes, less than 10 hours, less than 100 hours, or other suitable duration.

Displays may be characterized based on individual display measurements (i.e., each display that is manufactured may be individually characterized) or batches of displays may be binned by making measurements on each display and/or randomly sampled representative displays. Batches of displays can be binned using measurements on tagged devices fabricated under similar conditions to regular displays in the batches (e.g., comparable positions on a display mother glass, comparable times of manufacture, etc.).

As an example of this first type of characterizing arrangement, active area pixels and/or dummy pixels in a display may be stressed by displaying a [255, 255, 255] white image. Every 3 hours (or other suitable time interval), the luminance of each of the different colors of pixels (R, G, and B) can be individually measured. Once this aging behavior of the display is established using these measurements, the panel may be assigned to a performance bin (i.e., a batch of displays sharing display batch characteristics) and may be assigned appropriate predictive compensation parameters based at least partly on the display batch characteristics for use during compensation operations.

With a second illustrative approach, which may sometimes be referred to as an indirect correlation approach, the burn-in rate of displays can be binned (categorized) by correlation with other electrical, optical, and/or mechanical characteristics of the display. Examples of display characteristics that may be correlated with display aging performance and that may therefore be used in binning displays include: peak luminance, current versus voltage and/or luminance versus voltage for pixels 22, capacitance versus voltage versus frequency characteristics for pixels 22, pixel chromaticity, voltage headroom for pixels 22, geometric size for pixels 22 (e.g., measured with a microscope), etc.

If desired, fabrication conditions that are correlated with aging behavior can be monitored. Examples of fabrication conditions that can be monitored include deposition chamber pressure before, during and/or after display fabrication, partial pressure of selected molecule(s) and/or atom(s) before, during, and/or after display fabrication (e.g., of emissive material, etc.), thicknesses for one or more deposited layers (e.g., emissive material layers, etc.), duration of deposition of display layer(s), display location on a display mother glass during fabrication, etc.

With a third illustrative approach, representative pixels (sometimes referred to as tag pixels) in the display's active area or inactive area (i.e., dummy pixels) may be used in burn-in rate binning operations. The tag pixels preferably have been fabricated using similar fabrication processes to the fabrication processes being used for other pixels in the displays being binned. If desired, a photosensitive device located near the tag pixels may be used in measuring light emitted from the pixels to help characterize the pixels. The photosensitive device may be a discrete element located adjacent to a display (e.g., an ambient light sensor, etc.), may be a light detector incorporated into display 14, or may be other suitable light sensing device. Multiple devices may be used in sensing light, if desired. Reverse biased pixels can serve as detectors for light emitted by other pixels (i.e., light detectors may be incorporated into pixels 22). Tag pixels may be stressed under predetermined patterns (luminance and/or color versus time in various patterns, etc.) Luminance decay may be monitored using photosensitive devices on or adjacent to display 14 and/or using external equipment. External test equipment may also be used in making other display characterizing measurements. Tag pixels may be hidden from view by a viewer by placing tag pixels behind opaque masking layers or opaque component in device 10 and/or display 14. Tag pixels may be operated when display 14 is not operational (e.g., when device 10 is being charged and is not being actively used to display information for a user) or may be operated at other times. Tab pixels may be operated only when device 10 is in dark environments to minimize the impact of stray light or may be operated in other environments. Tag pixels may be aged periodically (e.g., by measuring pixel performance versus itself or a reference pixel that has not been aged). This may induce some degradation to the tag pixels to aid in the assignment of a binning parameter. A reference pixel that is not aged may be fabricated near to a tag pixel and the performance of both of these pixels may be measured for enhanced accuracy.

With a fourth illustrative arrangement, a built in photosensitive device such as an ambient light sensor may be used in monitoring display performance. Device 10 may include a photosensitive device such as an ambient light sensor and this sensor may, as an example, be used in gathering display measurements. The ambient light sensor may be used to monitor pixel aging for pixels 22 that are adjacent to the ambient light sensor. The detected signals can then be used in binning displays 14. Ambient light sensor detection operations may be initiated whenever ambient light levels are low (e.g., when display 14 is in a dark room). A number of different pixels 22 may be measured in a predetermined sequence and/or the pixels that are measured may be chosen based on actual or expected aging histories. Multiple measurements may be made to improve binning accuracy.

With a fourth illustrative arrangement, display pixel performance can be characterized electrically. As an example, current versus voltage characteristics, capacitance versus voltage characteristics, and other electrical characteristics can be gathered and used for display burn-in performance binning. For example, a current shift (e.g., a shift in measured current for a given drive voltage) may be associated with a particular burn-in behavior, a voltage shift at a particular current may be measured, and/or a capacitance shift at a given voltage may be measured and these measured values may be compared to previous measurements to help bin displays 14.

Figure 7:
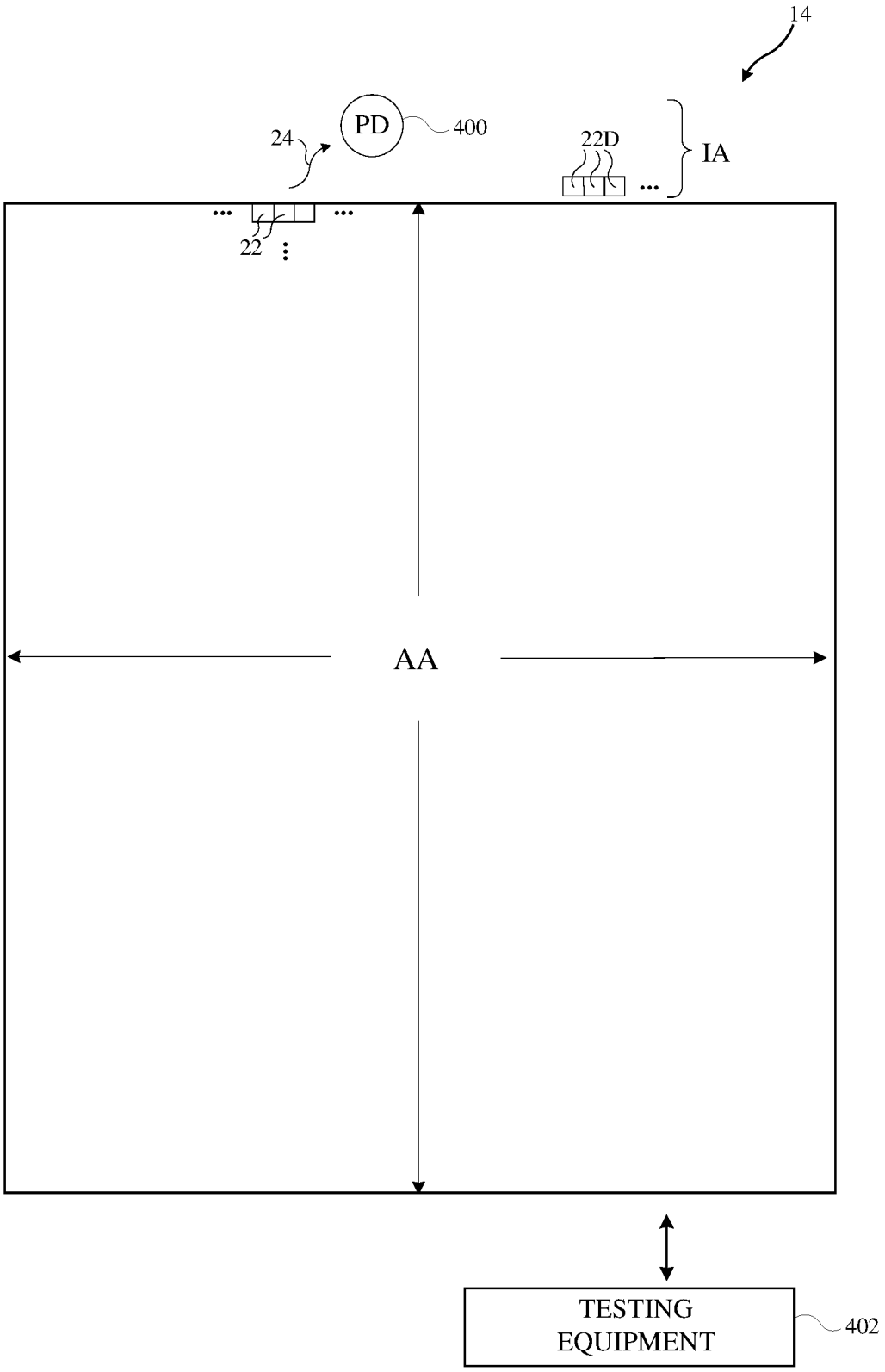
FIG. 7 is a diagram of a system in which a display may be characterized in accordance with an embodiment.

As shown in FIG. 7, display 14 may have an active area AA that contains an array of pixels 22 that display images for a user. Display 14 may also have one or more inactive border regions such as inactive area IA. Dummy pixels 22D may be formed in inactive areas IA. Photosensitive devices such as device 400 (e.g., an ambient light sensor or other light detector that is configured to measure light 24 from pixels 22 and/or 22D) may be used in characterizing display 22. Display 22 may also be characterized using control circuitry 16 and/or external testing equipment 402 (e.g., to make I-V and C-V measurements, luminance measurements, color measurements, etc.).

Figure 8:
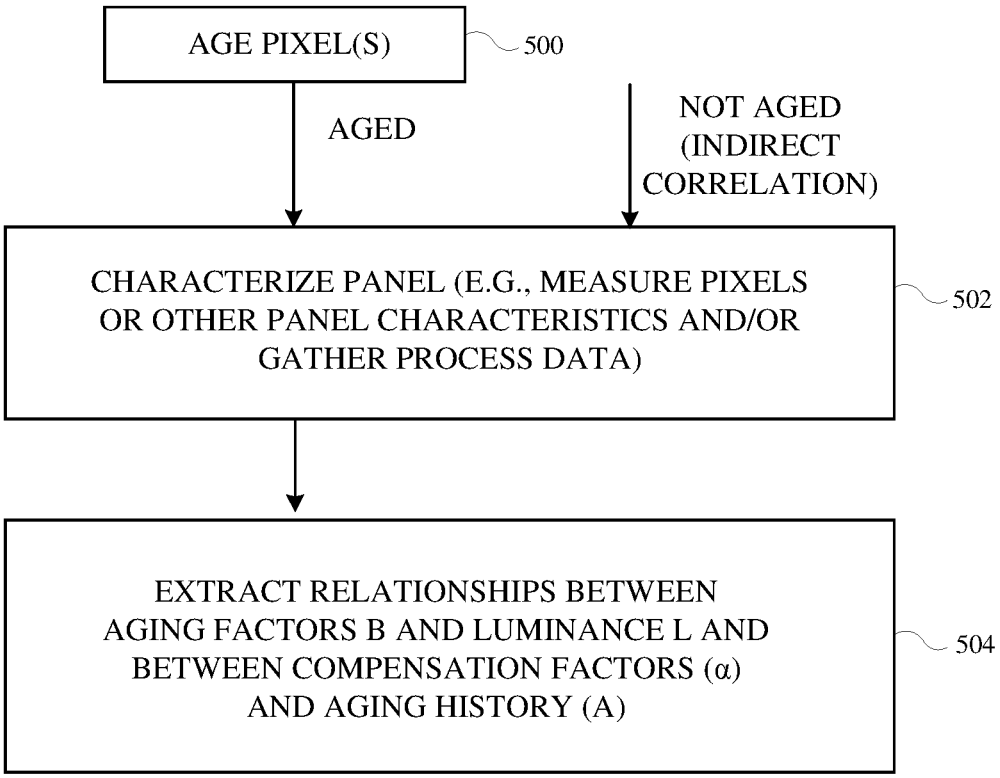
FIG. 8 is a flow chart of illustrative operations involved in characterizing displays in accordance with an embodiment.

Illustrative operations involved in charactering displays 14 to help improve burn-in compensation accuracy are shown in FIG. 8.

At step 500, pixels such as pixels 22 and/or 22D may be aged (e.g., by driving these pixels at normal intensities at normal temperatures and/or elevated intensities and/or elevated temperatures, etc.). If desired displays that do not have aged pixels may also be characterized (e.g., using indirect compensation techniques).

At step 502, displays containing pixels 22 and/or 22D may be characterized and assigned to batches of displays that have respective shared display batch characteristics. Displays may be characterized in the field or in the factory during manufacturing. Displays may be individually characterized and/or representative displays may be characterized (e.g., so that similar displays may be assigned to a batch). Batches (bins) of displays may be characterized by performing statistical analysis on one or more representative displays, thereby producing display batch characteristics (e.g., display batch characterization information that is representative of the displays in each batch).

Individual pixels may be measured and/or groups of pixels may be measured during the display characterization operations of step 502. The displays may be characterized using light detector 400, a light detector in equipment 402, reverse-biased pixels, or other light sensitive devices, may be characterized by making electrical measurements (current, voltage, capacitance, etc.), may be characterized by making luminance measurements on some or all of the pixels in each measured display, may be characterized by making color measurements, may be characterized by determining which fabrication process parameters were used in fabricating the displays, and may be characterized by collecting other information on the displays.

At step 504, the information that has been gathered may be processed so as to extract information for making burn-in predictions for one or more batches of similar displays and compensating the displays in each batch (bin) based on burn-in predictions associated with that batch. For example, relationships may be extracted between aging factors B and luminance L and between compensation factors α and aging history A for displays in a given batch of displays. The information on aging factors B that is gathered for a given batch of displays during step 504 by analyzing the display characterization data from the operations of step 502 may then be used in identifying values for aging factors B for displays in that given batch of displays during the operations of step 302 (FIG. 4) and the information on aging history A that is gathered for the given batch of displays during step 504 by analyzing the display characterization data from the operations of step 502 may then be used in identifying values for compensation factors α for displays in the given batch of displays during the operations of step 308 (FIG. 5). In this way, batch-specific display characteristics may be used to refine the burn-in compensation process. The compensation factors α for a given display are determined by identifying which batch of displays each display belongs to and, after identifying the display batch for a given display, by using the display batch characterization information for that batch of displays to identify appropriate values for the compensation factors α for the given display. As a result, the pixel luminance degradation compensator may adjust uncorrected pixel luminance values based at least partly on the display batch characterization information. This makes display burn-in compensation by the pixel luminance degradation compensator more accurate than would otherwise be possible.

Light exposure on display 14 may accelerate aging. To help predict and compensate for pixel luminance aging, light exposure information can be gathered using ambient light sensor 15 (FIG. 1). Ambient light sensor measurements with ambient light sensor 15 may be used in identifying the type of lighting environment in which device 10 is located. For example, a color ambient light sensor can gather spectral information from ambient light readings. This spectral information can then be used to identify whether ambient lighting is associated with sunlight, halogen lighting, incandescent lighting, fluorescent lighting, or other types of lighting. Aging may take place faster under lighting conditions with larger amounts of ultraviolet components (e.g., sunlight) than under other lighting conditions, so control circuitry 16 may use the spectral information obtained from the ambient light sensor to reconstruct the illuminance spectrum associated with the ambient lighting and thereby evaluate how much ultraviolet light is present in the ambient light. The ultraviolet light intensity information that is measured in this way can then be stored to develop a light exposure history for display 14 (e.g., an ultraviolet light exposure history). Predicted aging effects due to light exposure (e.g., ultraviolet light exposure) can be combined with aging effects due to pixel luminance history and/or temperature aging effects. For example, aging factors can be determined based on pixel luminance information, ambient light sensor measurements, and/or temperature measurements.

To conserve power, ambient light sensor signals that are gathered by control circuitry 16 using ambient light sensor 15 can be measured at a dynamic frequency (e.g., a variable sample rate). When ambient light levels are low for more than a threshold amount of time, the sampling frequency can be reduced. In response to detection of a high ambient light level, control circuitry 16 can dynamically increase the rate at which ambient light measurements are gathered. In this way, more frequent ambient light sensor measurements may be made under strong lighting conditions so that light exposure is accurately quantified. Cumulative light exposure information may be stored by control circuitry 16 in a data buffer.

Light exposure aging effects can be modeled by weighting pixel usage history with cumulative light exposure using equation 1.

$$L(cl,X,Y,t)=f(LE(t))*L_0(cl,X,Y,t) \quad (1)$$

In equation 1, $L_0(cl,X,Y,t)$ is the incremental aging at pixel locations (X,Y) for each R, G, and B color (cl) without considering light-accelerated degradation. Light exposure factor f(LE(t)) is an acceleration factor, which depends on cumulative light exposure LE. Control circuitry 16 may use the wavelength-dependent spectra and a wavelength-dependent acceleration factor to predict the degree of screen aging and the amount of compensation to be applied. If desired, color ambient light spectrum measurements (ambient light spectrum data) can be used to determine what type of ambient lighting is illuminating display 14 (e.g., incandescent, solar, fluorescent, warm LED, cold LED, etc.). Each of these lighting types has a predetermined weighting factor to determine the solar aging (ultraviolet) impact for that light source. The measured intensity of the light can be combined with this profile to update the total solar exposure aging factor.

Figure 9:
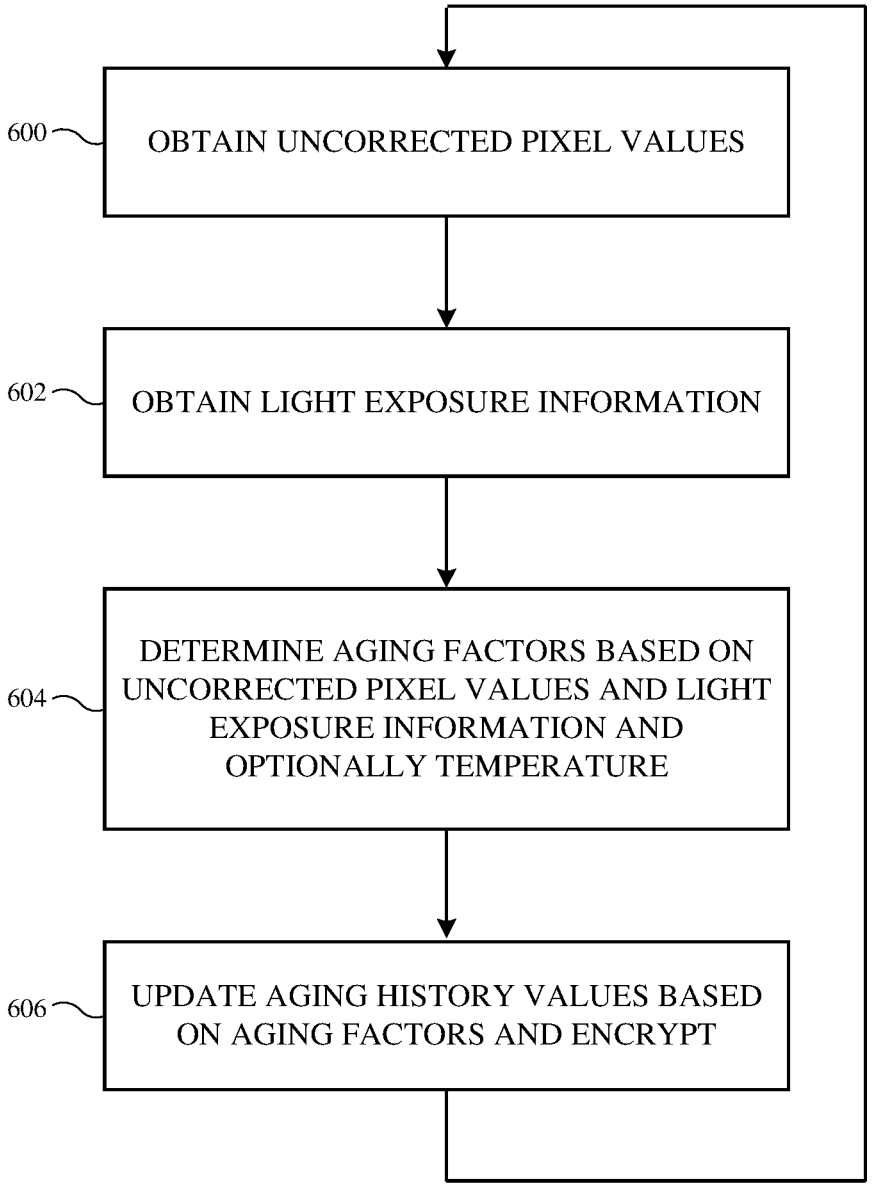
FIG. 9 is a flow chart of illustrative steps involved in maintaining pixel aging history information based on light exposure information in an electronic device with a display in accordance with an embodiment.

FIG. 9 is a flow chart of illustrative operations involved in maintaining pixel aging history information for display 14 based on light exposure information in device 10.

During the operations of block 600, luminance degradation compensator 202 may obtain uncorrected pixel luminance values for the content generated by content generator 200. For example, compensator 202 may obtain the pixel luminance value for each pixel in a frame of image data to be displayed on display 14. The luminance values may include an uncorrected red pixel luminance value $L_{R0}(x,y)$ for each red pixel, an uncorrected green pixel luminance value $L_{G0}(x,y)$ for each green pixel, and an uncorrected blue pixel luminance value $L_{B0}(x,y)$ for each blue pixel. There may be any suitable number of luminance values associated with each pixel (e.g., 0-255, etc.).

During the operations of block 602, historical information on the exposure of display 14 to ambient light (e.g., ultraviolet light) is obtained. This ultraviolet light exposure information may be obtained and retained in memory of control circuitry 16 whenever ambient light sensor 15 detects more than a threshold amount of ultraviolet light exposure. If desired, ambient light measurements may be taken more often (at a greater sampling frequency) when ambient light levels are high to help ensure accuracy.

Pixels at one luminance level (e.g., 0-10 nits) may age differently than pixels at another luminance level (e.g., 390-400 nits). Moreover, the amount of aging that each pixel experiences will generally be nonlinear as a function of luminance level (and temperature). For example, a pixel may degrade more if illuminated at 400 nits for one hour than if driven at 100 nits for four hours.

To take account of these aging effects, the aging behavior of the pixels may be ascertained during display testing and characterization and stored in the memory of control circuitry 16 (see, e.g., stored information 204). The aging behavior of the pixels may then be used in computing a value (sometimes referred to as an aging factor) for each pixel that represents how much a given pixel is being aged during a given display operation (e.g., when outputting light at a given luminance in an image frame). As shown in FIG. 9, aging factors B may be computed at step 604 based on the pixel luminance values in an image frame, based on information on the amount of light exposure (e.g., ultraviolet light exposure information gathered from color ambient light sensor measurements) for display 14, and, if desired, operating temperature. For example, ambient light sensor information such as historical visible light spectrum information or other historical measured ambient light spectrum information from a color ambient light sensor may be used to determine how much the pixels have been exposed to ultraviolet light. This light-exposure may be used in determining how much light-exposure-induced pixel luminance degradation has occurred in the light-emitting devices of the pixels, so that control circuitry 16 can compensate for these effects. For example, if outdoor lighting conditions are identified from a measured ambient light spectrum, the amount of ultraviolet light that the pixels are exposed to will be greater than if indoor lighting conditions are identified. Based on historical information such as color ambient light sensor information, pixel luminance information, and/or temperature information, a separate aging factor B may be computed for each pixel in display 14 or aging factors may be computed and stored for blocks of pixels (e.g., 2×2 blocks or blocks of other sizes and shapes) to conserve memory. In scenarios in which compensator 202 computes an aging factor for each pixel in the frame of image data obtained at step 300, a frame-sized matrix of aging factors may be computed at step 604.

Aging factors B may be computed for each different color of pixel in display 14. For example, under equal light illumination, red, green, and blue pixels in display 14 may each have a different corresponding value of aging factor B to take into account the varying aging behavior of each different pixel color under ultraviolet light exposure. If desired, temperature information (e.g., a current measured temperature value from sensor 140) may be used in computing aging factors B.

The matrix of aging factors for red, green, and blue pixels that is produced at step 604 (i.e., red pixel aging factors $B_R(x,y)$, green pixel aging factors $B_G(x,y)$, and blue pixel aging factor $B_B(x,y)$) may be maintained as part of information 204 by compensator 202. To ensure that a complete (lifetime) history of aging effects for display 14 is maintained, the aging factors for the current frame that have been computed at step 604 may be used in updating a cumulative history matrix of aging history values A (i.e., a running history) at step 604. Aging history information for display 14 such as aging history values A(x,y) may include red pixel aging history values $A_R(x,y)$, green pixel aging history values $A_G(x,y)$, and blue pixel aging history values $A_B(x,y)$. As with the aging factors B, aging history information may be stored in a matrix that is equal in size to the image frame (e.g., a matrix with an aging history for each pixel in display 14) or may be stored in a reduced-size matrix (e.g., a matrix in which 2×2 blocks of adjacent pixels share a common aging history value) to conserve memory. This aging history information, which may include aging information associated with pixel luminance history, pixel light exposure history, and/or temperature history, may optionally be encrypted during the operations of step 606 for secure storage in memory in control circuitry 16 to prevent unauthorized inspection. After the current aging factors B have been used to update the aging history A for the pixels in display 14, processing may loop back to step 600. A new set of uncorrected pixel values may be obtained and processed in this way at a frequency of f1. Frequency f1 may be, for example, 60 Hz (e.g., frequency f1 may correspond to the frame rate at which display 14 displays frames of image data). Other frequencies f1 may be used when performing the operations of FIG. 9, if desired (e.g., f1 may be 0.005 Hz to 60 Hz, etc.).

The process of FIG. 9 may run continuously while image data is being displayed on display 14. In parallel, compensator 202 may maintain a set of pixel luminance compensation factors to apply to the uncorrected pixel values (see, e.g., FIG. 5, which is a flow chart of illustrative operations involved in using current aging history information to update a set of pixel compensation values).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a display having pixels, each pixel having a respective light-emitting device;

control circuitry configured to display content on the pixels of the display;

an ambient light sensor; and a pixel luminance degradation compensator implemented on the control circuitry configured to use ambient light sensor measurements from the ambient light sensor to compensate for light-exposure-induced pixel luminance degradation in the light-emitting devices, wherein the ambient light sensor measurements include ambient light spectrum information, and wherein the control circuitry is configured to use the ambient light spectrum information to compensate for the light-exposure-induced pixel luminance degradation.

2. The electronic device defined in claim 1 wherein the light-emitting devices comprise light-emitting diodes.

3. The electronic device defined in claim 2 wherein the ambient light sensor comprises a color ambient light sensor.

4. The electronic device defined in claim 1 wherein the control circuitry is configured to use the ambient light spectrum information to produce pixel aging factors for the pixels.

5. The electronic device defined in claim 1 wherein the control circuitry is configured to use the ambient light sensor to determine an amount that the pixels are exposed to ultraviolet light over time.

6. The electronic device defined in claim 5 wherein the control circuitry is configured to implement a pixel luminance degradation compensator and is configured to produce pixel aging factors for the pixel luminance degradation compensator based at least partly on the amount that the pixels are exposed to the ultraviolet light over time.

7. The electronic device defined in claim 1 wherein the control circuitry is configured to implement a pixel luminance degradation compensator.

8. The electronic device defined in claim 7 wherein the pixel luminance degradation compensator is configured to maintain pixel aging history information for the pixels.

9. The electronic device defined in claim 8 wherein the ambient light sensor comprises a color ambient light sensor configured to gather an ambient light spectrum and wherein the pixel luminance degradation compensator is configured to use the ambient light spectrum to maintain the pixel aging history information.

10. The electronic device defined in claim 9 further comprising a temperature sensor that provides temperature measurements to the pixel luminance degradation compensator, wherein the pixel luminance degradation compensator is configured to determine the pixel aging factors based at least partly based on the temperature measurements.

11. The electronic device defined in claim 10 wherein the pixel luminance degradation compensator is configured to adjust the pixel luminance values for the pixels by applying compensation factors to the pixel luminance values and wherein the compensation factors are based at least partly on the pixel aging factors.

12. An electronic device, comprising:

a display having pixels, wherein each of the pixels has a respective light-emitting diode;

an ambient light sensor configured to gather ambient light information; and control circuitry on which a content generator and a pixel luminance degradation compensator are implemented, wherein the content generator is configured to produce image content for the display with uncorrected pixel luminance values and wherein the pixel luminance degradation compensator is configured to adjust the uncorrected pixel luminance values based at least partly on the history of the ambient light information to produce corresponding corrected pixel luminance values for the image content to compensate for ambient-light-induced pixel luminance degradation in the light-emitting diodes.

13. The electronic device defined in claim 12 wherein the pixel luminance degradation compensator is configured to produce the corrected pixel luminance values by applying compensation factors to the uncorrected pixel luminance values.

14. The electronic device defined in claim 13 wherein the light-emitting diodes comprise organic light-emitting diodes.

15. The electronic device defined in claim 13 wherein the light-emitting diodes comprise discrete crystalline semiconductor dies.

16. The electronic device defined in claim 12 further comprising a temperature sensor that gathers temperature measurements, wherein the pixel luminance degradation compensator is configured to produce the compensation factors at least partly based on the temperature measurements.

17. The electronic device defined in claim 16 wherein the pixel luminance degradation compensator is configured to produce the compensation factors based on encrypted pixel aging history information maintained in the control circuitry.

18. The electronic device defined in claim 17 wherein the pixel luminance degradation compensator is configured to adjust the uncorrected pixel luminance values based at least partly on the encrypted pixel luminance history information to produce corresponding corrected pixel luminance values for the image content.

19. An electronic device, comprising:

an organic light-emitting diode display having pixels;

a color ambient light sensor configured to gather ambient light sensor measurements indicative of an amount of exposure of the pixels to ultraviolet light over time; and control circuitry on which a content generator and a pixel luminance degradation compensator are implemented, wherein the content generator is configured to produce image content for the display with uncorrected pixel luminance values and wherein the pixel luminance degradation compensator is configured to adjust the uncorrected pixel luminance values based at least partly on the amount of exposure of the pixels to ultraviolet light to compensate for ultraviolet-light-induced luminance degradation and produce corresponding corrected pixel luminance values for the image content.

* * * * *